US008113214B2

(12) United States Patent
Sieredzinski

(10) Patent No.: US 8,113,214 B2
(45) Date of Patent: Feb. 14, 2012

(54) APPARATUS FOR CONDITIONING OF ORGANIC MATERIALS

(75) Inventor: Marek Sieredzinski, Radom (PL)

(73) Assignee: International Tabacco Machinery Poland Ltd., Radom (PL)

( * ) Notice: Subject to any disclaimer, the term of this patent is extended or adjusted under 35 U.S.C. 154(b) by 1385 days.

(21) Appl. No.: 11/634,204

(22) Filed: Dec. 6, 2006

(65) Prior Publication Data

US 2007/0125393 A1 Jun. 7, 2007

(30) Foreign Application Priority Data

Dec. 6, 2005 (PL) ..... 378285

(51) Int. Cl.
*A24B 3/00* (2006.01)
*A24B 15/00* (2006.01)

(52) U.S. Cl. ..... 131/300; 131/108; 131/303; 131/290; 131/304

(58) Field of Classification Search ..... 131/296–297, 131/302, 304
See application file for complete search history.

(56) References Cited

U.S. PATENT DOCUMENTS

| | | | | |
|---|---|---|---|---|
| 4,489,505 | A | 12/1984 | Hench et al. | |
| 4,546,780 | A * | 10/1985 | Akutsu et al. | 131/304 |
| 5,711,086 | A * | 1/1998 | Stubbing | 34/77 |
| 5,755,238 | A * | 5/1998 | Soots et al. | 131/302 |
| 2004/0255964 | A1 * | 12/2004 | Draghetti et al. | 131/108 |

FOREIGN PATENT DOCUMENTS

| | | | |
|---|---|---|---|
| DE | 41 00 162 | A1 | 7/1992 |
| DE | 196 25 338 | A1 | 1/1998 |
| GB | 613 166 | A | 11/1948 |

* cited by examiner

*Primary Examiner* — Richard Crispino
*Assistant Examiner* — Phu Nguyen
(74) *Attorney, Agent, or Firm* — Nixon & Vanderhye

(57) ABSTRACT

Apparatus for conditioning of organic materials including an inlet gate, an outlet gate, a conditioning chamber having a set of nozzles for supplying thermodynamic medium, and an immobilizing device. The set of nozzles and the immobilizing device are arranged in relation to each other such that thermodynamic medium flowing through the set of nozzles places organic material in the immobilizing means and flows over conditioned organic material placed in the immobilizing means.

7 Claims, 1 Drawing Sheet

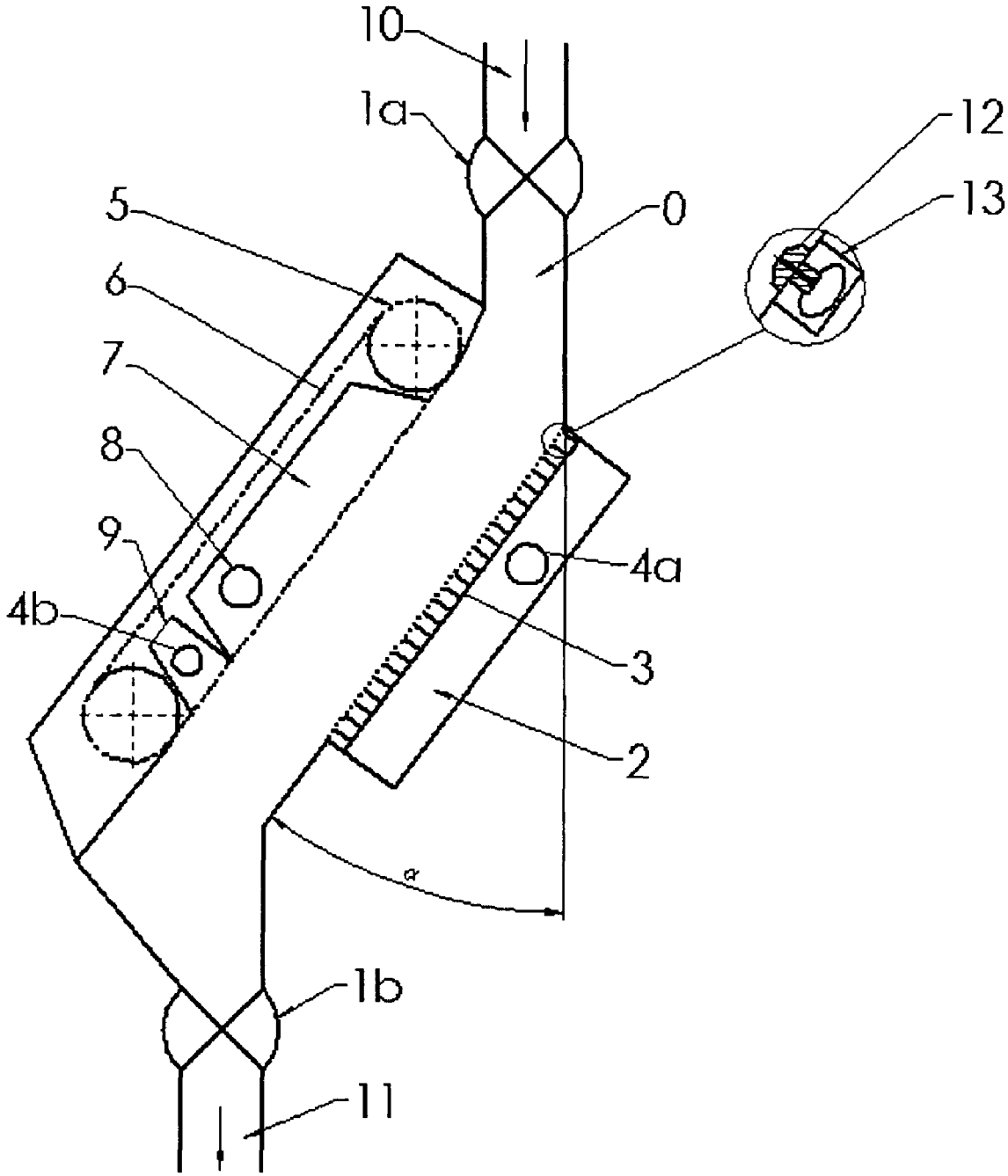
10
1a
12
13
5
0
6
7
8
9
4a
4b
3
2
α
1b
11

APPARATUS FOR CONDITIONING OF ORGANIC MATERIALS

Present invention relates to the apparatus for conditioning of organic materials.

BACKGROUND OF THE INVENTION

In the process of conditioning of organic materials, for example tobacco, it is extremely important to precisely control parameters of the conditioning process, this is particularly difficult in a case of the fine particles of the organic material exposed to the thermodynamic medium of high absolute speed and high relative speed in relation to the particles being conditioned. The main problem in a such process is controlling the parameters of nonlaminar stream of mass consisting of particles of the conditioned organic material and thermodynamic medium, in respect to the particular particles of the organic material.

The other problem related with the conditioning using thermodynamic medium is the mechanical degradation of organic materials resulting in dusting related to the high friction and inter-particles interaction being a result of the relative motion of organic material particles. Swirling in a mass, fine organic material particles hit each other, this leads to particles ripping out, particles breaking down which results in dusting, and to the loss in the amount and quality of the organic material being conditioned.

There are several apparatus for conditioning of organic materials known in the state of the art. U.S. Pat. No. 5,908,032 discloses a method and apparatus for expansion of tobacco, which is using a channel in a form of letter C, wherein tobacco is transported by hot gaseous medium.

U.S. Pat. No. 5,711,086 discloses an apparatus for continuous drying in a superheated steam. Apparatus disclosed comprises a drying chamber and an assembly of the conveyor belts transporting material being dried. Superheated steam is generated inside the drying chamber from the moisture coming from the material being dried, as a result of exposing the material to hot gas or the moisture is introduced into to the chamber from the external source of the superheated steam.

U.S. Pat. No. 4,044,780 discloses an apparatus for expanding in volume of the cut tobacco, the apparatus comprises first unit increasing tobacco temperature and humidity to the state where tobacco particles open. Such apparatus comprises additionally separate unit for creating a thin layer of opened organic material particles in the gas atmosphere and a unit for rapid cooling.

U.S. Pat. No. 6,185,843 discloses a dryer where the transport of the organic material is carried out using pneumatic means. The shape of the inlet channel is decreasing the contact of the tobacco particles with internal surfaces of the transport channel.

EP patent no. 1 033 081 discloses a method of expanding the food products or tobacco using superheated steam as transport medium.

SUMMARY OF THE INVENTION

According to the invention apparatus for conditioning the organic material comprises inlet gate, conditioning chamber and outlet gate. Further conditioning chamber comprises:

a set of nozzles supplying thermodynamic medium, and immobilizing means for immobilizing organic material, placed in relation to each other in a such way that the flowing thermodynamic medium flows over conditioned organic material placed in the immobilizing means.

According to the invention a set of nozzles is placed in relation to the immobilizing means in a such way that the flowing thermodynamic medium is placing the organic material in the immobilizing means.

According to the invention immobilizing means is a net.

Further according to the invention the net is a net of the conveyor belt with adjustable speed of movement.

According to the invention the conditioning chamber has a vertical configuration.

And further according to the invention the conditioning chamber deviates from the vertical direction by an angle from 0° to 80°, preferably around 40°.

According to the invention the thermodynamic medium is selected from the group comprising steam, air, gases, vapors as well as their solutions and/or aerosols.

Further according to the invention a set of nozzles is covered by the bottom sieve.

Thanks to the introducing an apparatus according to the invention is possible to obtain increased intensity of the process as well as a better control over the conditioning process, each particle of the organic material is placed in the constant conditioning conditions for a precise determined period of time when the conditioning process takes place. Thanks to apparatus according to the invention the process of conveying heat to/from organic material is better controlled, further the process of conveying moisture and/or volatile substances to/from organic material can be also better controlled.

Immobilizing organic material particles for the time of conditioning process avoids mechanical degradation, for example dusting, tensional deflection or shrinking of the organic material particles.

Apparatus according to the invention allows using jointly or independently different thermodynamic mediums, for example superheated steam, air, conditioning substances, their solutions, other gases and vapors and aerosols.

BRIEF DESCRIPTION OF THE DRAWING

Present invention has been described in detail below in relation to the preferred embodiment disclosed on FIGURE attached to the description, which presents an apparatus according to the invention for conditioning of organic materials.

DETAILED DESCRIPTION OF PREFERRED EMBODIMENTS

In the preferred embodiment of the invention an apparatus for conditioning of organic materials disclosed on FIGURE comprises inlet gate 1*a* where the organic material is introduced through the supplying channel 10, such organic material is for example tobacco to be conditioned inside the apparatus.

The inlet gate 1*a* is connected with the conditioning chamber 0, conditioning chamber 0 deviates from the vertical direction by an angle $\alpha$ in a range from 0° to 80°, preferably around 40°.

Inside the conditioning chamber 0, at its bottom there is placed a set of nozzles 12, 13 covered by the bottom sieve 3. The set of nozzles 12, 13 is supplied from the external source (not show) through inlet 4*a*, with thermodynamic medium of controlled physiochemical parameters chosen appropriately to the organic material being conditioned, conditioning parameters and other parameters that are proper to the conditioning process, estimated by the person skilled in the art of the conditioning organic materials. The set of nozzles 12, 13 is directing the stream or streams of the thermodynamic medium through the sieve mesh of the bottom sieve 3, towards immobilizing unit 5, 6.

In the upper part of the conditioning chamber there is placed an immobilizing unit 5, 6 for immobilizing particles of the organic material, the unit comprising a net 6 of the conveyor belt 5. The net 6 immobilizes in relation to each other organic material particles. A unit for immobilizing organic material particles is provided additionally with outlet chamber 7 collecting used thermodynamic medium, which is transported outside the apparatus through the outlet channel 8 for recycling in the recycling unit (not shown), for example for dedusting or for the change the physicochemical parameters for example by heating, moisturizing etc. Further immobilizing unit comprises inlet 4*b* of the thermodynamic medium placed in a such way that it directs the stream of the thermodynamic medium downwards towards the net 6 for removing the organic material particles from the net 6 in the discharging area 9.

In the bottom part of the conditioning chamber the outlet gate 1*b* is placed. The outlet gate is discharging an organic material outside the apparatus for conditioning.

The apparatus according to the invention disclosed on FIGURE operates as described below.

An organic material, for example tobacco, is delivered from the outside to the inlet gate 1*a* through supplying channel 10. Inlet gate 1*a* controls the process of supplying an organic material to the conditioning chamber 0.

An organic material is introduced into the conditioning chamber 0, where it flows down towards the bottom sieve 3. A set of nozzles 12, 13 is placed below the bottom sieve 3 and directs stream or streams of thermodynamic medium of proper physicochemical parameters towards immobilizing unit 5, 6.

The streams of the thermodynamic medium carry organic material particles towards the immobilizing unit 5, 6, where due to a high speed of the thermodynamic medium, the organic material particles are placed in the net 6 of the conveyor belt 5 constituting the immobilizing unit 5, 6. Placed in the net the organic material particles are immobilized in relation to each other, further they are exposed to the thermodynamic medium flowing with high speed over the immobilized organic material particles. The time period for which the organic material is within the area of exposing to the thermodynamic medium is precisely controlled due to the possibility of the adjusting the speed of the conveyor belt.

The conveyor belt 5 transports organic material towards the discharging area 9, where the stream of the thermodynamic medium directed from the bottom of the net 6 removes the organic material particles from the net 6, and directs the particles towards the outlet gate 1*b* discharging the organic material through the channel 11 outside the apparatus for conditioning.

The thermodynamic medium is supplied from the external source (not show) through the inlet openings 4*a*, 4*b*, used thermodynamic medium is discharged from the apparatus for conditioning through the discharging opening 8 of the chamber 7 for discharging used thermodynamic medium to the recycling unit (not shown), where thermodynamic medium can be recycled, for example dedusted, heated or moistened etc.

The thermodynamic medium is a gas, preferably steam in any form, including superheated steam in the temperature range of 120° C. to 320° C., preferably in a range of 170° C. to 270° C. Thermodynamic medium can be air, preferably hot air in the temperature range of 80° C. do 280° C. Thermodynamic medium may be also any combination of aerosols and/or chemical vapors, as well as gases, for example argon, nitrogen, carbon dioxide etc, which may favorably influence the conditioning process and/or give specific organoleptic properties of the conditioned material.

An apparatus for conditioning may be supplied with different thermodynamic mediums at the same time, for example if the thermodynamic medium is air alone, preferably low humidity air, then the apparatus for conditioning being a drier. Speed of drying increases with the increase of the temperature of the thermodynamic medium, relative humidity and relative speed between organic material and thermodynamic medium. Along with increase of the relative speed the Nusselt number increases which intensifies exchange of the heat and mass (for example water) between thermodynamic medium and organic material. Described above process parameters can be controlled by adjusting speed of circulation for thermodynamic medium. The time period of exposing the organic material to the thermodynamic medium can be controlled by regulation of the conveyor belt speed.

Thermodynamic medium could be chosen from the group comprising nitrogen, argon, carbon dioxide or other non reactive gas, then apart from intensive drying the thermodynamic medium can be heated to the temperature above ignition point of the organic material being dried, this allows not only drying but also allows expansion (swelling) of the organic material.

In a case when the thermodynamic medium is a steam with a small addition of air, organic material after introducing into an apparatus is moistened to the point where no condensation appears. This leads to increase of the humidity of an organic material. Keeping an organic material longer in the area of exposing to the thermodynamic medium by lowering the speed of the net of the conveyor belt or by increasing temperature (considerably higher than the saturation temperature), the organic material can be expanded, and than dried to achieve final humidity. To increase expansion of the material additional steam can be used, the additional steam can be supplied by additional set of nozzles (not shown) placed just behind the inlet gate 1*a*.

Additionally, the conditions in the process, in particular immobilizing organic material particles results in a less shrinking, which is favorable for some kind of the organic materials.

An apparatus for conditioning of organic materials may be supplied with many different thermodynamic mediums in many different conditioning processes or can be supplied with many different thermodynamic mediums in a single conditioning process.

The invention claimed is:

1. Apparatus for conditioning of organic materials comprising:

a conditioning chamber having a bottom;

an inlet gate located on top of the conditioning chamber; and an outlet gate located at the bottom of the conditioning chamber for discharging the conditioned material;

said conditioning chamber deviating from the vertical direction by an angle ($\alpha$) in a range from 0° to 80° and comprising:

a set of nozzles supplying thermodynamic medium, and immobilizing means placed in an upper part of the conditioning chamber, the set of nozzles and the immobilizing means being located on opposite sidewalls of the conditioning chamber such that the thermodynamic medium flowing through said set of nozzles places the organic material flowing down from the inlet gate onto the immobilizing means and flows over the conditioned organic material placed on the immobilizing means.

2. Apparatus according to claim 1 wherein the immobilizing means is a net.

3. Apparatus according to claim 2, wherein the net is a net of a conveyor belt with adjustable speed of movement.

4. Apparatus according to claim 1 wherein the conditioning chamber has a vertical configuration.

5. Apparatus according to claim 1 wherein the thermodynamic medium is selected from the group consisting of steam, air, gases, vapors, their solutions and aerosols.

6. Apparatus according to claim 1 wherein the set of nozzles is covered by a bottom sieve.

7. Apparatus according to claim 1 wherein the conditioning chamber deviates from the vertical direction by an angle of about 40°.

* * * * *